United States Patent [19]

Hibbs et al.

[11] 4,278,026

[45] Jul. 14, 1981

[54] ROCKET MOTOR IGNITER, ARMING FIRING DEVICE

[75] Inventors: Joseph E. Hibbs; Gerald W. Chalmers, both of Ridgecrest, Calif.; Robert L. Durrell, Columbia, Md.; Walter C. Smith, China Lake, Calif.

[73] Assignee: The United States of America as represented by the Secretary of the Navy, Washington, D.C.

[21] Appl. No.: 84,487

[22] Filed: Oct. 15, 1979

[51] Int. Cl.[3] ..... F42C 15/40

[52] U.S. Cl. ..... 102/254; 60/39.82 E; 89/1.814; 102/202; 102/262

[58] Field of Search ..... 102/254, 262, 202, 200, 102/49.7; 89/1.807, 1.812, 1.813, 1.814; 60/39.09 R, 39.82 E, 256

[56] References Cited

U.S. PATENT DOCUMENTS

| | | | |
|---|---|---|---|
| 3,052,784 | 9/1962 | Ousley | 102/262 |
| 3,408,937 | 11/1968 | Lewis et al. | 102/201 |
| 3,658,009 | 4/1972 | Allen | 102/254 |
| 4,019,441 | 4/1977 | Morgan et al. | 102/262 |
| 4,036,144 | 7/1977 | Meek | 102/254 |
| 4,046,076 | 9/1977 | Hampton | 102/262 |

*Primary Examiner*—Charles T. Jordan

*Attorney, Agent, or Firm*—R. S. Sciascia; W. Thom Skeer; Luther A. Marsh

[57] ABSTRACT

An arming-firing device that provides handling safety in a rocket motor. The arming-firing device provides pyrotechnic (out-of-line) and electrical (open circuit) safety features wherein the arming-firing device is armed by rotating a mechanical rotor by a solenoid that aligns multiple prongs of the barrier with multiple cavities of the rotor and this action simultaneously electrically arms (closes circuits) and mechanically enables the igniter whereupon receiving a firing signal starts the rocket motor. The mating of the barrier prongs with the rotor cavities obviates rebounding, thus affording proper ignition. The mechanical barrier and a solenoid return spring prevents inadvertent firing from any cause.

12 Claims, 5 Drawing Figures

| ROCKET MISSILE | GROUND TEST/ ASSEMBLY AREA | SHIP TEST AREA | SHIP AIRCRAFT | AIRCRAFT GROUND | AIRCRAFT AIRBORNE | IGNITION CAUSE | | | IGNITION FREQUENCY | |
|---|---|---|---|---|---|---|---|---|---|---|
| | | | | | | MAN | MACHINE | UNKNOWN | NUMBER OF INCIDENTS | PERCENT |
| ZUNI | 1 | 1 | 1 | 2 | 9 | 5 | 1 | 8 | 14 | 27 |
| SPARROW | 1 | - | 1 | 7 | 4 | 6 | - | 7 | 13 | 25 |
| 2.75 INCH | 4 | 1 | - | 4 | 3 | 6 | 3 | 3 | 12 | 23 |
| SIDEWINDER | 1 | 2 | 2 | 2 | 4 | 4 | 6 | 1 | 11 | 21.2 |
| SHRIKE | - | - | - | 1 | 1 | 1 | - | 1 | 2 | 3.8 |
| TOTAL | 7 | 4 | 4 | 16 | 21 | 22 | 10 | 20 | 52 | 100 |

FIG. 2

ROCKET MOTOR IGNITER, ARMING FIRING DEVICE

BACKGROUND OF THE INVENTION

Various electro-mechanical arming-firing means have been and currently are used to maintain a guided missile in an unarmed position until it is ready for launching. Some of the various types are illustrated in FIG. 1. The proliferation of so many different arming-firing means has created inadequate ordnance safety. Some safety failures have been catastrophic, especially when they have occurred aboard ships.

This invention illustrates an arming-firing means that can be utilized with many guided missile systems. The utilization of a safe arming-firing device that is compatible with many guided missile systems is an absolute necessity in view of accidental ignition frequency as shown in FIG. 2.

SUMMARY OF THE INVENTION

The safety arming-firing device of the present invention provides a safe arming-firing device which can interface with many guided missile systems. This invention uses an igniter, an electrically initiated translating pressure sleeve squib assembly (EID), as described and claimed in U.S. Pat. No. 4,046,076, and assigned to same assignee, as a part of the safe arming-firing device of this invention. The description of the (EID) as described and claimed in U.S. Pat. No. 4,046,076 is incorporated herein by reference.

The safe arming-firing device of this invention is armed by rotating a mechanical rotor having multiple cavities therein in line with a translating pressure sleeve squib assembly with a mechanical barrier having multiple prongs located and attached at the forward end of the sleeve squib assembly forty five degrees. The rotary motion is brought about by a solenoid using lesser energy than motors heretofore used in this function. A torsional return spring attached at the base of the solenoid automatically rotates the mechanical barrier back to a safe position if during the missile arming and firing sequence, the arming voltage is removed or if there is an electrical malfunction which causes loss of electrical power to the arming-firing device. Upon activation of the arming-firing sequence the moment of inertia of the torsional return spring is overcome thus allowing the moment of force within the spring to automatically rotate the mechanical barrier back to a safe position in case of any malfunction. The automatic resafing of this invention is proven by over fifty thousand activations in qualification testing and actual fleet usage of the missile qualified solenoid. The pressure sleeve assembly is also keyed and retained by a shear pin to eliminate any movement under ship or other transportation vibrations.

The safety arming-firing device of the present invention also provides a fiber optics system which allows visual inspection of the arming-firing device to determine whether the device is in a safe or armed condition. The fiber optics system allows viewing of a visual indicator located and attached at the forward end of the rotor from outside the missile airframe.

BRIEF DESCRIPTION OF THE DRAWINGS

Illustrative examples of the present invention are illustrated in the accompanying drawings wherein:

FIG. 2 is an illustrative comparison of motor ignition incidents for five different types of rocket missile systems;

DESCRIPTION OF THE PREFERRED EMBODIMENTS

Figure 1:
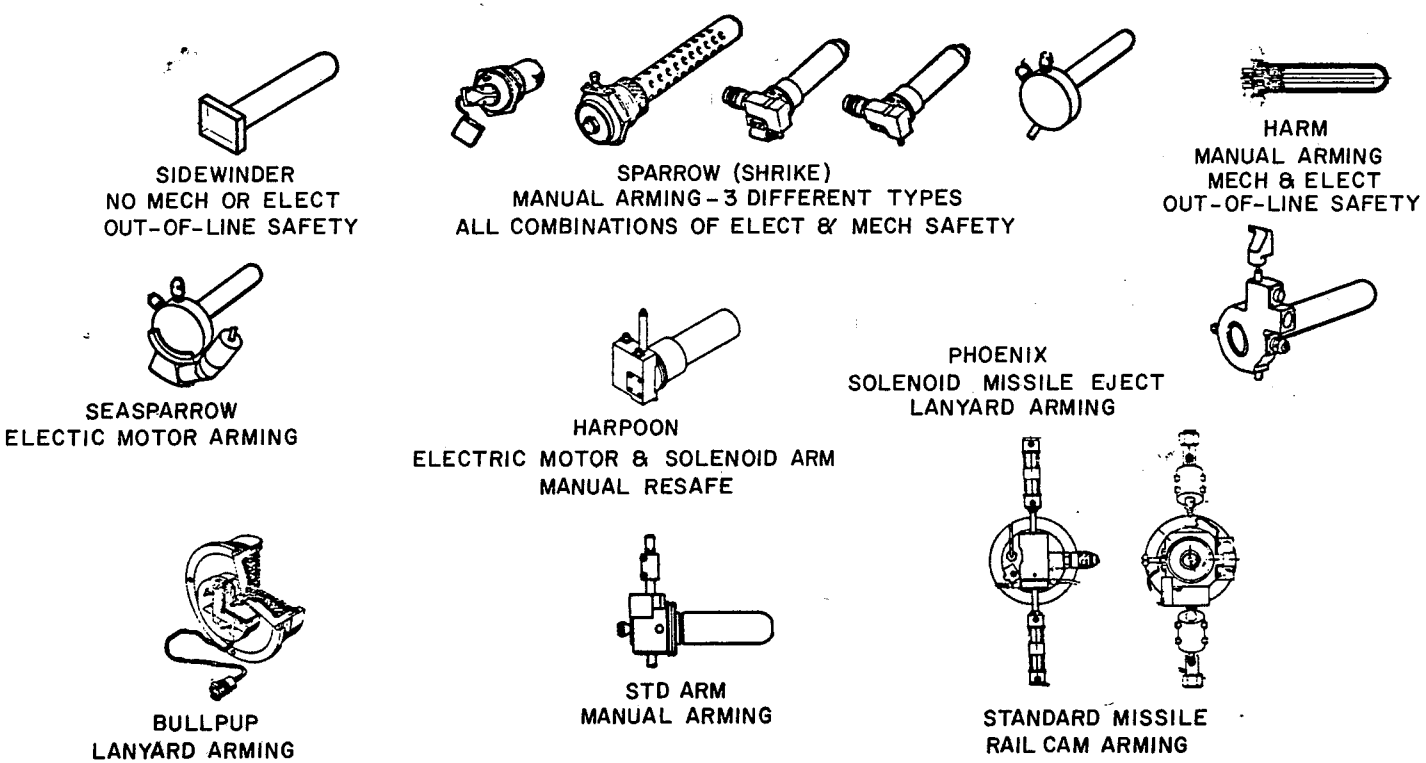
PRIOR ART FIG. 1
FIG. 1 is an illustrative depiction of the proliferation of guided missile rocket motor arming-firing devices.
Figure 3:
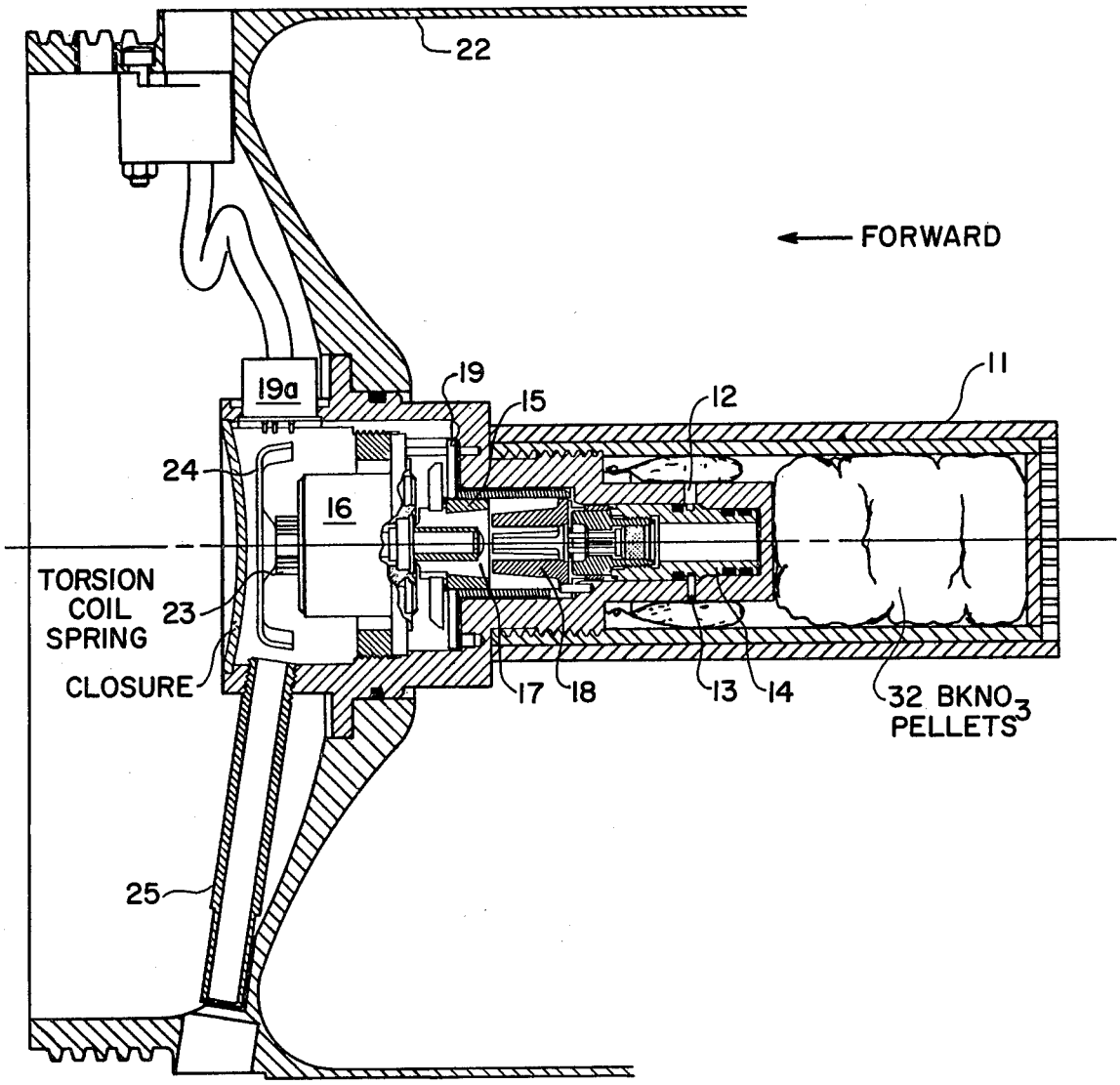
FIG. 3 is a longitudinal sectional view of a safety-arming device in the safe position interfaced for illustrative purposes with a SEA SPARROW rocket motor igniter.
Figure 4:
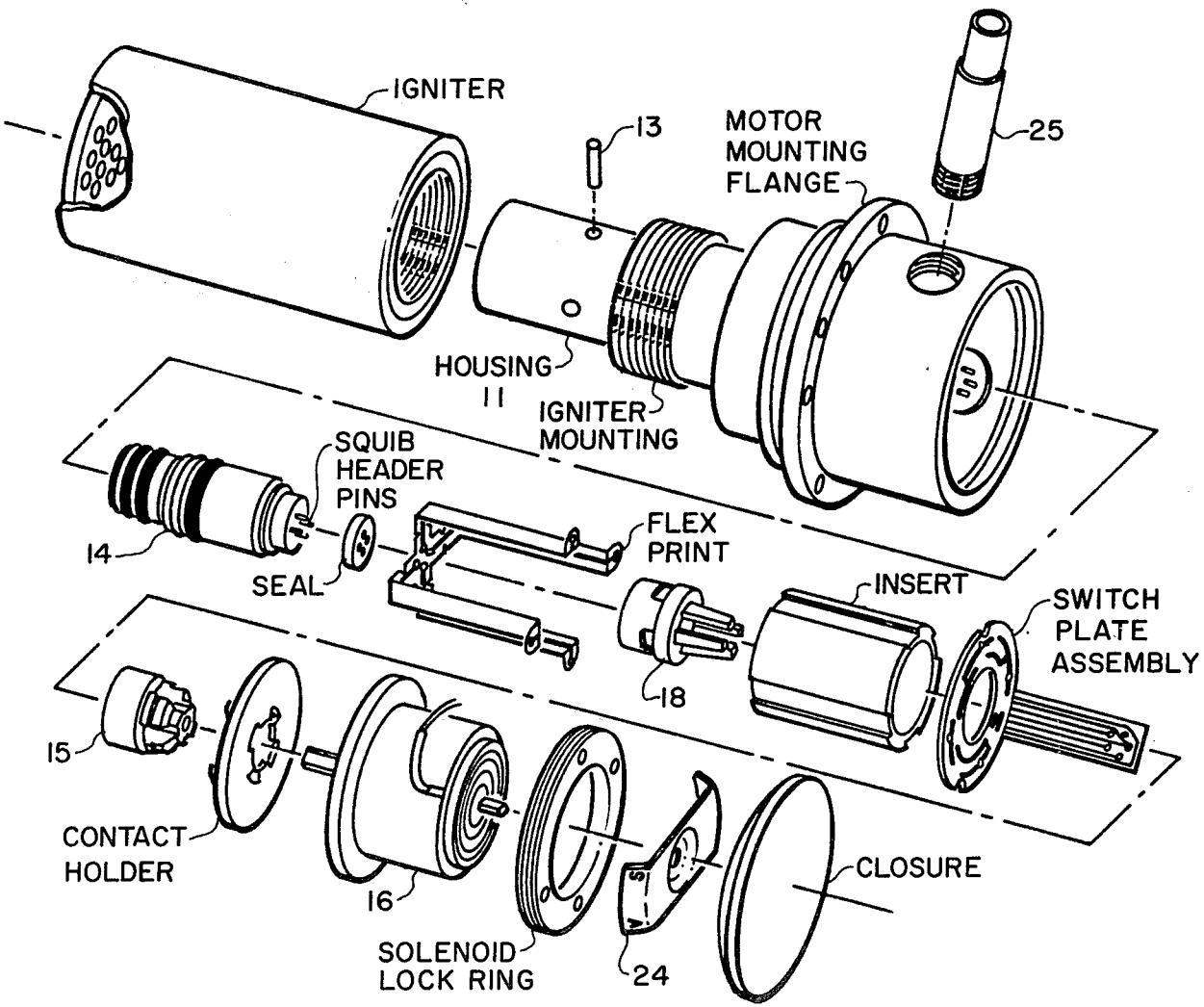
FIG. 4 is a perspective exploded view of detailed parts of the mechanical solenoid and fiber optic system and its relationship to the overall arming-firing device.
Figure 5:
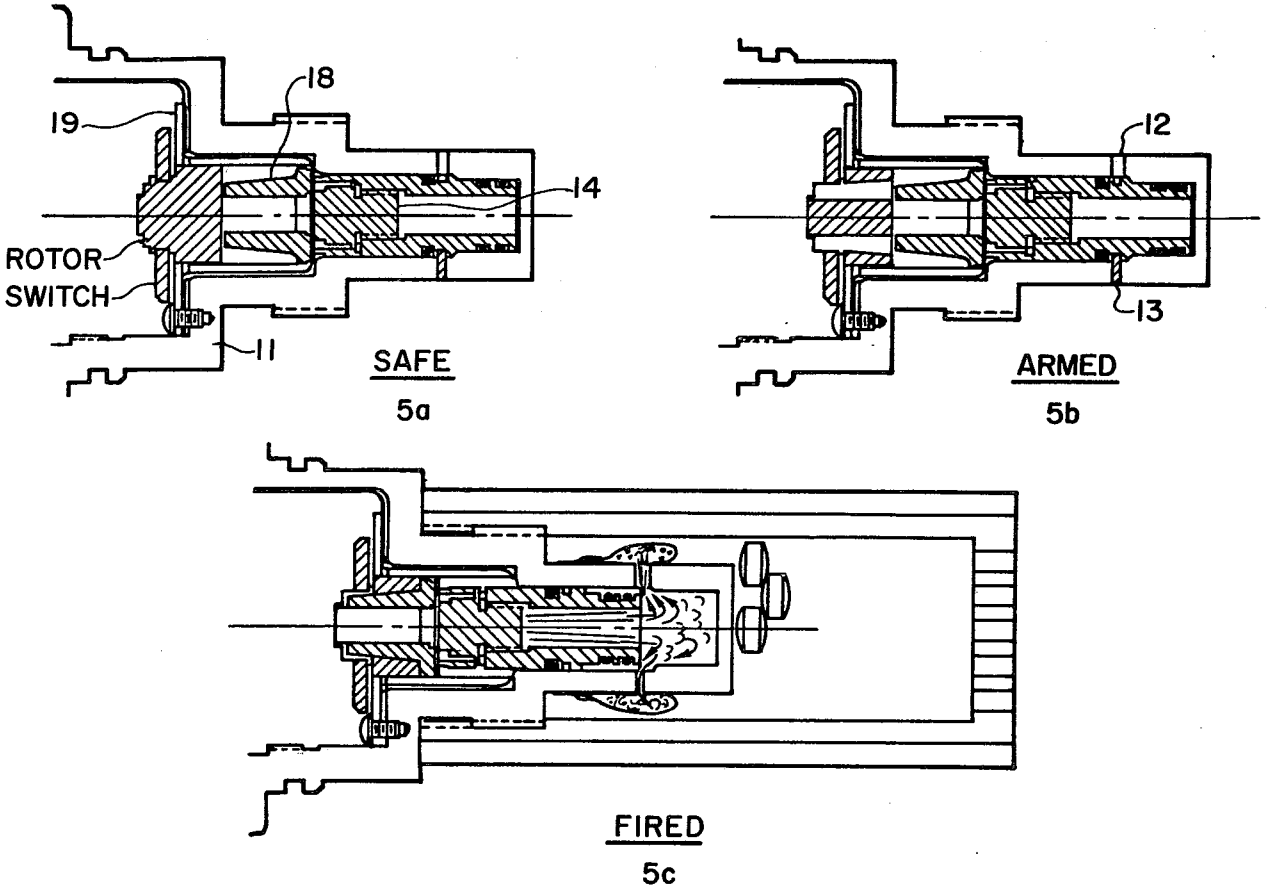
FIG. 5 is a longitudinal sectional view of a safety-arming device illustrated in a safe, armed and fired condition.

Referring now to the drawings in FIGS. 3, 4 and 5 wherein like reference numerals correspond to like parts and elements through the several figures there is shown in FIG. 3 an elongated cylinder housing 11 equipped with vent ports 12 and shear pin 13. Within housing 11 resides an electrically initiated translating pressure sleeve squib assembly 14, that operates as described and claimed in U.S. Pat. No. 4,046,076. The operation of the pressure sleeve squib 14 is incorporated herein by reference. The safe arming-firing device as shown in FIGS. 3, 4 and 5 arms by rotating a mechanical rotor 15 in line with the translating pressure sleeve squib assembly 14. A solenoid 16 rotation aligns multiple tapered cavities 17 of the rotor with multiple barrier tapered prongs 18 located forward of squib assembly 14 and attached thereto. Upon alignment, the safe arming-firing device automatically arms electrically and mechanically. That is, all electrical circuits 19 are automatically closed upon mechanical alignment of barrier prongs 18 and rotor cavities 17. The tapered barrier prongs 18 and rotor cavities 17, upon alignment, provide an interference which locks the two together with a wedging action, and thus prevents rebounding upon firing. The elimination of rebounding upon firing allows the arming-firing device upon receipt of a firing signal to initiate the squib assembly 14 which upon initiation, its gas pressure causing the pressure sleeve part of squib assembly 14 to translate forward with respect to housing 11, opening vent ports 12. This motion causes hot gases from the squib assembly 14 to reach igniter pellets 32 through vent ports 12, thus igniting the igniter pellets 32 and starts rocket motor 22 burning. The wedging action caused by mating tapered barrier prongs 18 and rotor cavities 17 allows positive ignition of igniter pellets 32 by eliminating rebounding of pressure sleeve port of squib assembly 14, thus allowing positive ignition of rocket motor 22.

Torsional coil spring 23 engages solenoid 16 at all times and, prior to mechanical enabling, and upon inadvertent initiation of squib assembly 14 or if during missile arming and firing sequence the arming voltage is removed or an electrical malfunction causing loss of electrical power, it rotates mechanical barrier 18 back to the safe position. Exhaustive tests of automatic resafing of spring 23 has been proven in qualification testing and actual usage.

An indicator 24 is attached to rotating solenoid 16 and so positioned wherein positive visual inspection of safe or armed condition of arming-firing device is shown by exterior observation viewer 25 utilizing fiber optics. The observation viewer allows viewing of indicator 24 from outside rocket motor 22.

FIG. 4 further illustrates detailed parts of arming-firing device and identified by name if not identified in discussion supra. FIG. 5 further illustrates a sectional view of detailed interrelationships of rotor 15 barrier prongs 18, rotor cavities 17, vent ports 12, shear pin 13 in the safe, armed and fired condition.

The advantages of the safe arming-device of this invention are many. A totally rotary solenoid 16 is utilized which eliminates motors used previously, has an attached torsional coil spring 23 which if any malfunction occurs in the energy source, prior to mechanical enabling, returns the solenoid 16 and mechanical rotor 15 to a safe position and upon alignment of rotor 15 tapered cavities 17 barrier tapered prongs final arming is accomplished as part of the launch sequence and eliminates manual arming.

A further advantage is the mechanical out-of-line barrier 18 which prevents inadvertent igniter initiation. The rotor 15 barrier 18 combination when fired in the armed condition as shown in FIG. 5 prevents any rebound thus allowing positive initiation of igniter through their wedging action.

Another advantage of the arming-firing device of this invention is that it is designed to interface with any missile system. This allows use in multiple weapon systems thus results in a higher confidence level for the determination of safety feature reliability.

Still another advantage is the use of fiber optics allowing viewing outside of the missile inspection of the arming-firing device to determine whether the unit is in the safe or armed condition.

Other advantages through modifications to the basic teaching of the safe arming-firing are available to those skilled in the art.

The embodiments illustrated are exemplary and variations can be made in construction and arrangement within the invention's scope as defined in the appended claims.

What is claimed is:

1. A safety-arming device for preventing unintentional ignition of a rocket motor, comprising:

a housing defining a plurality of vent ports;

a pressure sleeve squib assembly attached within said housing and having a plurality of vent ports;

a rotary solenoid located forward of said squib having a rotor with multiple cavities therein;

a barrier located between said rotor and said squib having multiple prongs defined to fit said cavities in said rotor;

said barrier interconnected with said squib;

a solenoid return spring attachably interconnected to said rotor; and an exterior observation viewer so attached through said housing to afford interior visual inspection of said barrier.

2. The safety-arming device of claim 1 wherein:

said pressure sleeve squib assembly is keyed and retained by a shear pin.

3. The safety-arming device of claim 1 wherein:

said rotary solenoid cavities are tapered.

4. The safety-arming device of claim 1 wherein:

said barrier prongs are tapered.

5. The safety-arming device of claim 1 wherein:

said solenoid spring is a torsional spring.

6. The safety-arming device of claim 1 wherein:

said exterior observation viewer is for affording an interior positive inspection of said barrier to ascertain whether device is safe or armed.

7. A safety-arming device for preventing unintentional ignition of a rocket motor, comprising:

a housing means having a plurality of vent ports;

a pressure sleeve squib assembly means attached within said housing means for ignition of said rocket motor;

a rotary solenoid means located forward of said squib, having multiple cavities therein, for rotation of a barrier to an armed position to an input signal;

a barrier means located between said rotor and said squib and interconnected thereto and having multiple prongs defined to fit said cavities in said rotor for giving a wedging action to the barrier and rotor, thus attentuating rebound of the barrier and interference with ignition of the rocket motor;

a solenoid return spring means interconnected to said rotor for rotating said barrier to a safe position if during arming and firing sequence the arming voltage is removed or if there is an electrical malfunction which causes loss of electrical power to said safety-arming device; and an exterior observation viewer means for affording interior visual inspection of said barrier.

8. The safety-arming device of claim 7 wherein:

said pressure sleeve squib assembly is keyed and retained by a shear pin for the elimination of any moment under transportation vibrations.

9. The safety-arming device of claim 7 wherein:

said rotary solenoid cavities are tapered for interlocking said barrier prongs to prevent any rebound and thus allowing proper initiation of said igniter means.

10. The safety-arming device of claim 7 wherein:

said barrier prongs are tapered for interlocking within said rotary solenoid cavities to prevent any rebound and thus allowing proper ignition of said igniter means.

11. The safety-arming device of claim 7 wherein:

said solenoid spring is a torsional spring for rotating said barrier back to a safe position in the event of any malfunction.

12. The safety-arming device of claim 7 wherein:

said exterior observation viewer means is so designed for affording a positive inspection of said barrier to ascertain whether device is safe or armed.

* * * * *